US005800222A

United States Patent [19]

Nanami

[11] Patent Number: 5,800,222

[45] Date of Patent: Sep. 1, 1998

[54] TWIN JET DRIVE FOR WATERCRAFT

[75] Inventor: Masayoshi Nanami, Hamamatsu, Japan

[73] Assignee: Sanshin Kogyo Kabushiki Kaisha, Shizuoka, Japan

[21] Appl. No.: 514,431

[22] Filed: Aug. 11, 1995

[30] Foreign Application Priority Data

Aug. 11, 1994 [JP] Japan ..... 6-189440

[51] Int. Cl.[6] ..... B63H 11/08; B63H 11/113

[52] U.S. Cl. ..... 440/38; 440/40; 440/42

[58] Field of Search ..... 440/38, 40–43, 440/46, 47; 60/221, 222

[56] References Cited

U.S. PATENT DOCUMENTS

| | | | |
|---|---|---|---|
| 3,641,964 | 2/1972 | Lee | 440/42 |
| 4,086,867 | 5/1978 | Stricker et al. | 440/47 |
| 4,276,035 | 6/1981 | Kobayashi | 440/47 |

FOREIGN PATENT DOCUMENTS

| | | | |
|---|---|---|---|
| 5-50988 | 3/1993 | Japan . | |
| 405229483 | 9/1993 | Japan | 440/38 |
| 5-330485 | 12/1993 | Japan . | |

*Primary Examiner*—Sherman Basinger

*Attorney, Agent, or Firm*—Knobbe, Martens, Olson & Bear, LLP

[57] ABSTRACT

A number of embodiments of jet propulsion systems for watercraft that employ twin impellers contained within a common housing assembly at the end of a common inlet duct having a single water inlet opening that can be positioned centrally of the watercraft to avoid drawing air in during abrupt maneuvering. By using twin impellers, the use of straightening vanes can be substantially eliminated. In addition, a small dividing wall extends from the area forwardly of the impellers only into the water inlet ducts sufficiently so as to reduce counter-effects of swirling from between the two impellers and without requiring any substantial change in direction of the water flow from the water inlet opening to the impellers.

24 Claims, 14 Drawing Sheets

TWIN JET DRIVE FOR WATERCRAFT

BACKGROUND OF THE INVENTION

This invention relates to a twin jet drive for watercraft and more particularly to an improved compact, high efficiency, jet propulsion system for a watercraft.

It is well known that jet propulsion units have a number of advantages over conventional propeller type propulsion systems used in watercraft. This is particularly true in conjunction with inboard mounted jet propulsion units because they can be positioned so that the propulsion unit does not spoil the exterior appearance of the watercraft. In addition, the other advantages of jet propulsion units can be enjoyed with such inboard mounted units.

However, like conventional propellers and, in some instances even more so, cavitation is a problem with the impeller operation of the jet propulsion unit. That is, if large powers are attempted to be exerted on the impeller, cavitation and loss of the efficiency can occur. This is particularly true if the impeller is driven at high speed.

One way in which the jet propulsion unit may absorb larger powers without causing cavitation is to utilize plural jet propulsion units. By using plural units, larger powers can be absorbed without cavitation.

However, since the water inlet for the jet propulsion units are normally disposed on the underside of the hull, if side-by-side twin jet propulsion units are employed, their water inlet openings are disposed at a substantial distance from the hull underside center line. Thus, when maneuvering and, particularly when executing turns, all or a portion of one of the water inlets may rise above the water level resulting in loss of pumping efficiency.

It has been proposed, therefore, to provide a single water inlet for both side-by-side units so that the water inlet opening can be centrally disposed on the underside of the hull. In addition to reducing the likelihood that air will be drawn when executing abrupt maneuvers, such an arrangement results in minimization of the disturbance of the hull undersurface and easer sealing against leakage.

However, if a common water inlet opening is utilized, then the operation of the twin jet propulsion units may be compromised. One reason for this is that the operation of the impeller tends to cause a swirling action in the inlet side of the jet propulsion unit. This swirling motion can cause a counter-effect between the side-by-side units that can decrease their pumping efficiency.

It is, therefore, a principal object of this invention to provide an improved twin jet propulsion unit having a common water inlet for each jet propulsion section.

It is a further objection of this invention to provide a jet propulsion unit of this type wherein the operation of the adjacent impellers does not interfere with each other.

Although various types of devices may be provided for avoiding the swirl in the water inlet opening, these generally would require the use of straightening vanes or other devices which will adversely affect the ability of the system to ingest water without restriction.

If it, therefore, a still further object of this invention to provide an improved water inlet system for a twin jet propulsion unit that will not have any of the aforenoted disadvantages and wherein the use of straightening vanes in the inlet section is substantially eliminated.

SUMMARY OF THE INVENTION

This invention is adapted to be embodied in a jet propulsion unit for a watercraft. The jet propulsion unit is comprised of a pair of impeller sections, each containing a respective impeller. The impellers are driven by a prime mover arrangement for drawing water and discharging it through a discharge nozzle for providing a propulsion force. The water inlet is comprised of a single water inlet opening that branches into two sections, each serving a respective impeller. The branching section is configured in such a way that the swirling motion that tends to be generated at the inlet to each impeller is isolated from that of the other impeller.

DETAILED DESCRIPTION OF THE PREFERRED EMBODIMENTS OF THE INVENTION

Figure 1:
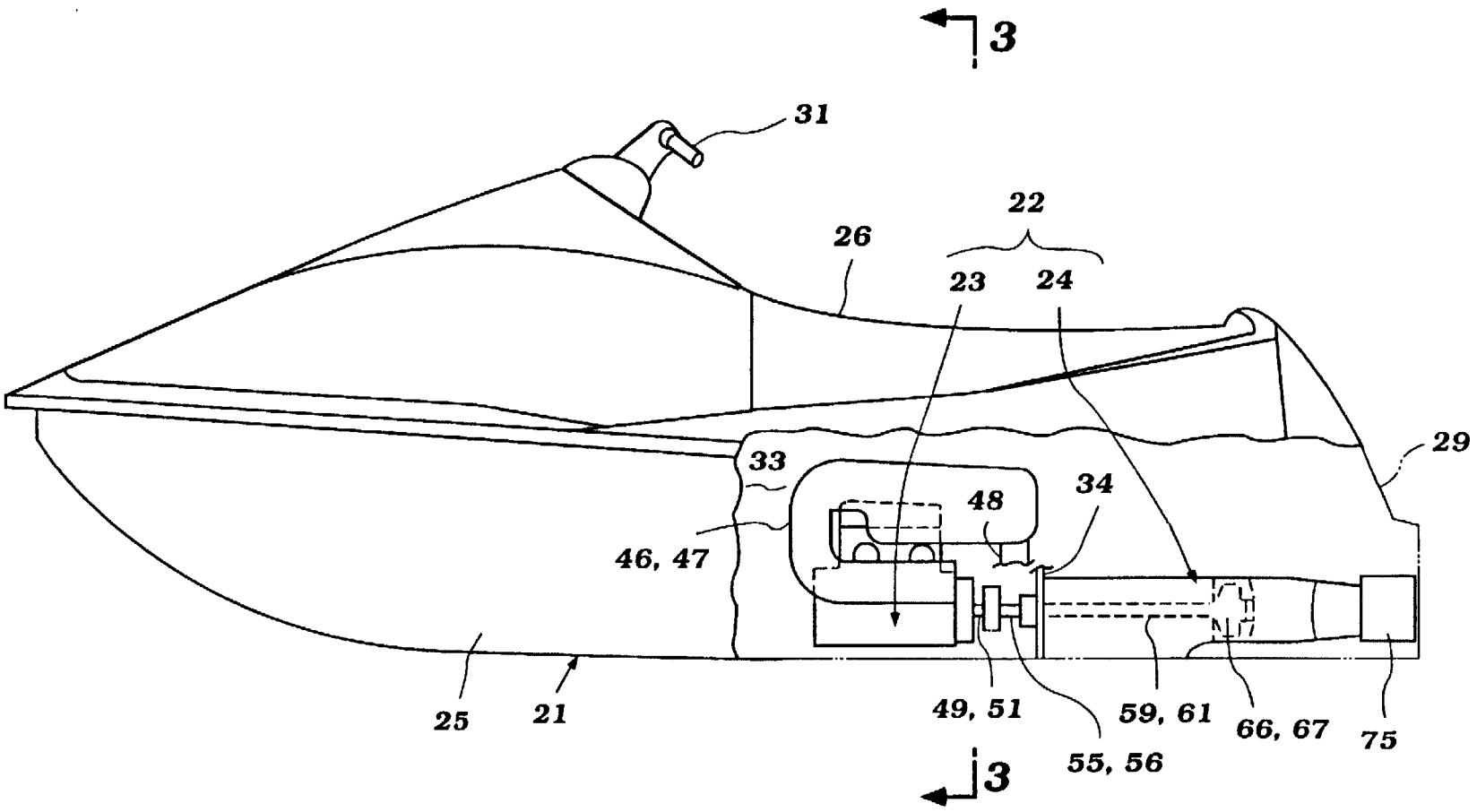
FIG. 1 is a side elevational view of a watercraft powered by a twin jet propulsion unit constructed in accordance with an embodiment of the invention.
Figure 2:
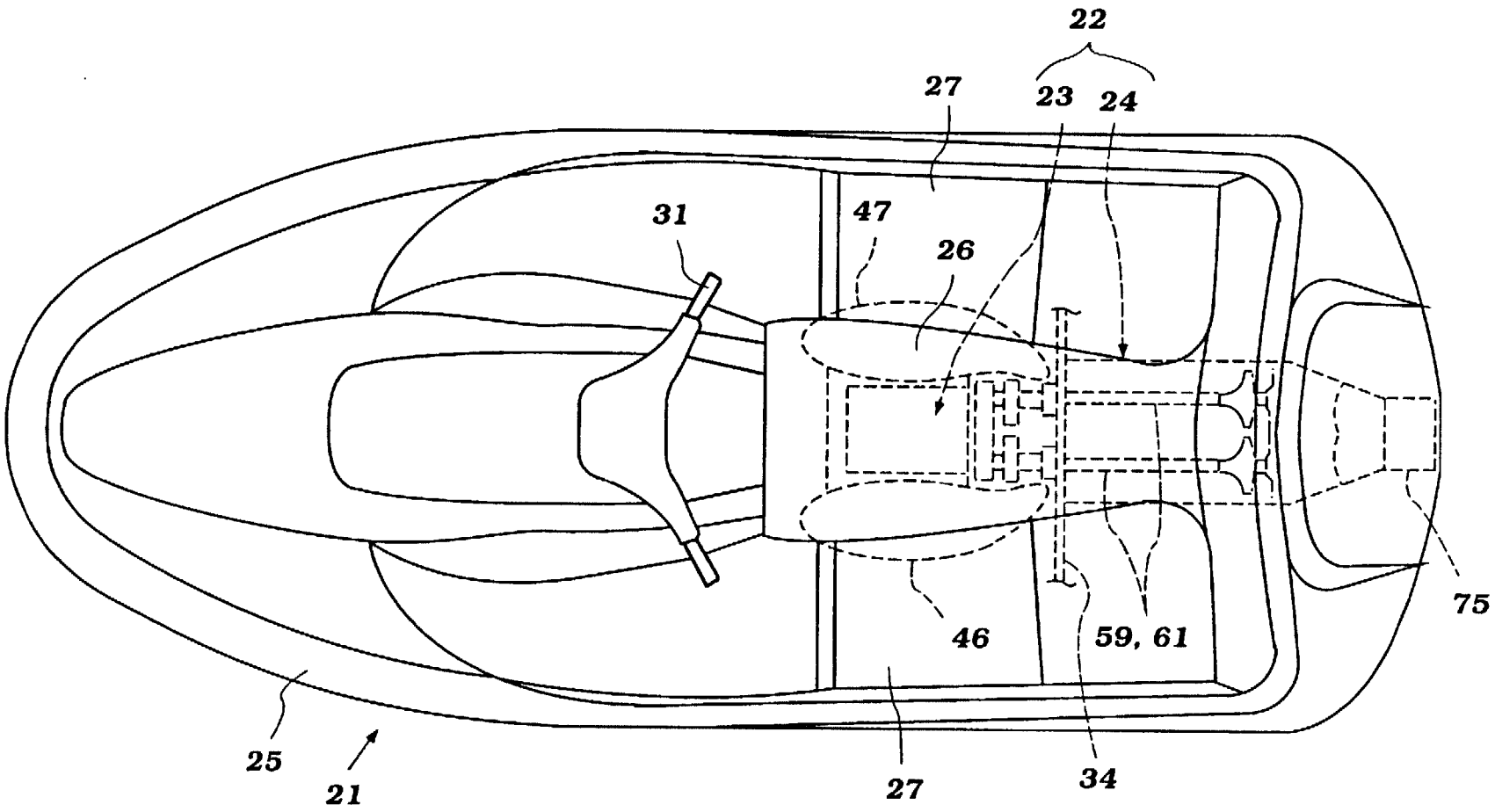
FIG. 2 is a top plan view of the watercraft.
Figure 3:
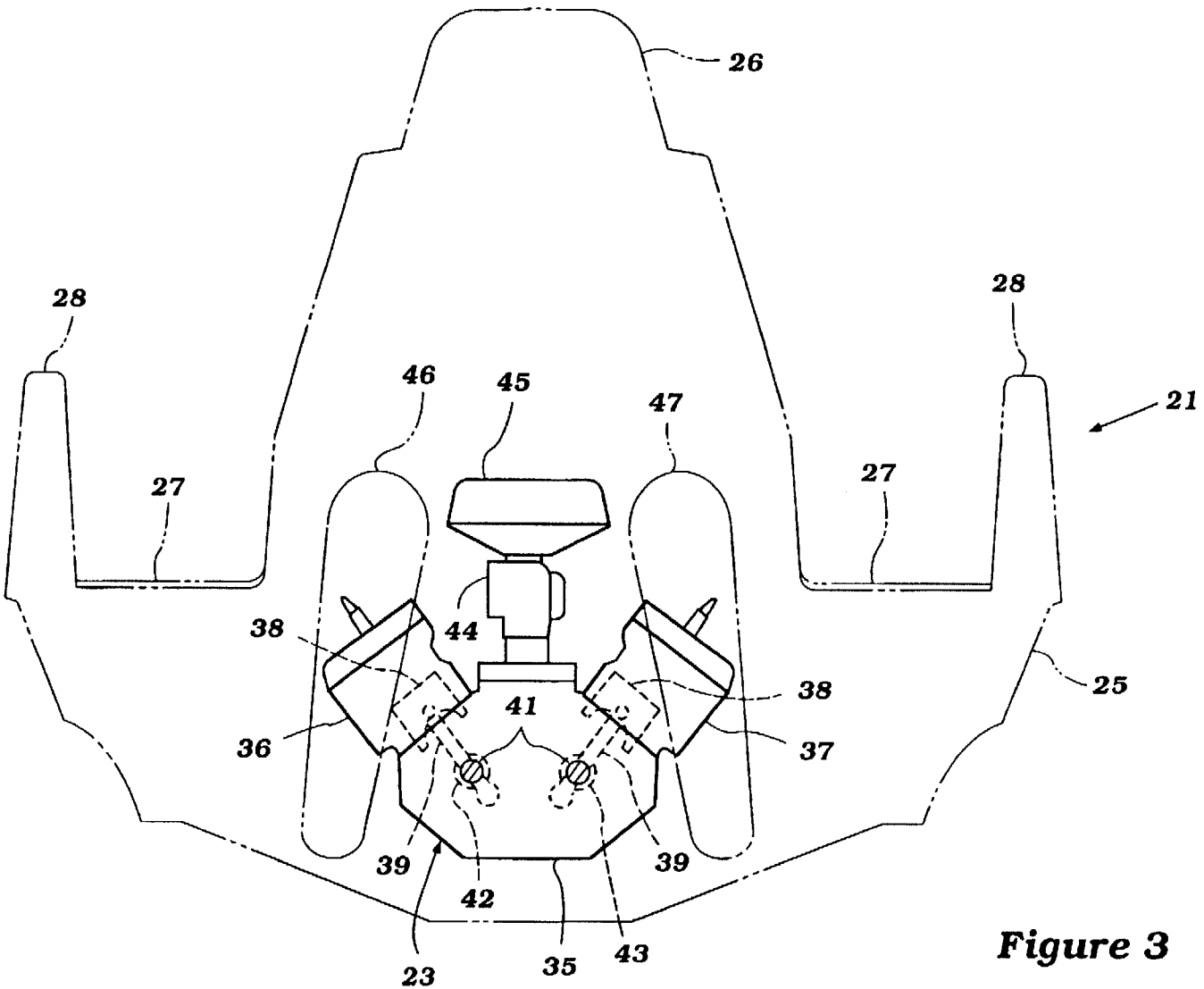
FIG. 3 is an enlarged cross-sectional view taken along the line 3—3 of FIG. 1, but showing the hull of the watercraft and certain components of the exhaust system in phantom.

Referring now in detail to the drawings and initially to FIGS. 1–3, a watercraft constructed in accordance with an embodiment of the invention is indicated generally by the reference numeral 21. It is to be understood that the invention deals primarily with the propulsion system for the watercraft, which propulsion system is indicated generally by the reference numeral 22. The propulsion unit is comprised of a powering internal combustion engine 23 and a jet propulsion unit 24 and the associated transmission therefor.

Since the invention deals primarily with the propulsion unit, the description of the watercraft 21 which will follow is to be considered as a typical environment in which the invention may be employed. The specific type of watercraft illustrated is a personal watercraft. The invention has particular utility with such watercraft, although its application is not so limited, due to the compact nature of these types of watercraft.

The watercraft 21 is comprised of a hull 25 which may be formed from any suitable material, such as a molded fiberglass reinforced resin, or the like. The rear portion of the hull 25 defines a passenger's compartment. The passenger's compartment consists of a raised centrally positioned seat 26 that is bounded by a pair of foot areas 27 on the opposite sides thereof. The seat 26 is configured so as to accommodate one or more riders seated in straddle tandem fashion, with their feet in the foot areas 27.

The foot areas 27 are bounded at their outer peripheral edges by raised gunnels 28 so as to offer protection for the rider or riders. However and as is typical with this type of watercraft, the foot areas 27 open through the rear or transom 29 of the watercraft so that the riders may easily board the watercraft from the body of water in which the watercraft is operating.

A handlebar assembly 31 is positioned in the rider's area forwardly of the seat 26 so as to be operated by the forwardmost rider seated thereon. The handlebar assembly 31 is coupled to a discharge nozzle, to be described, of the jet propulsion unit 24 for steering of the watercraft in a well known manner. In addition, other watercraft controls, such as a throttle, may be provided on the handlebar assembly 31. The throttle may be of the twist-grip type and is coupled to the throttle valve of the engine 23, also in a well known manner, so as to control the speed of the engine 23.

As has been noted, the description of the watercraft 21 is to be considered to be primarily for establishing an environment in which the invention may be utilized. The propulsion system 22 will now be described by continuing reference to FIGS. 1–3, and by additional reference to FIGS. 4 and 5, where this unit is shown in more detail.

Figure 5:
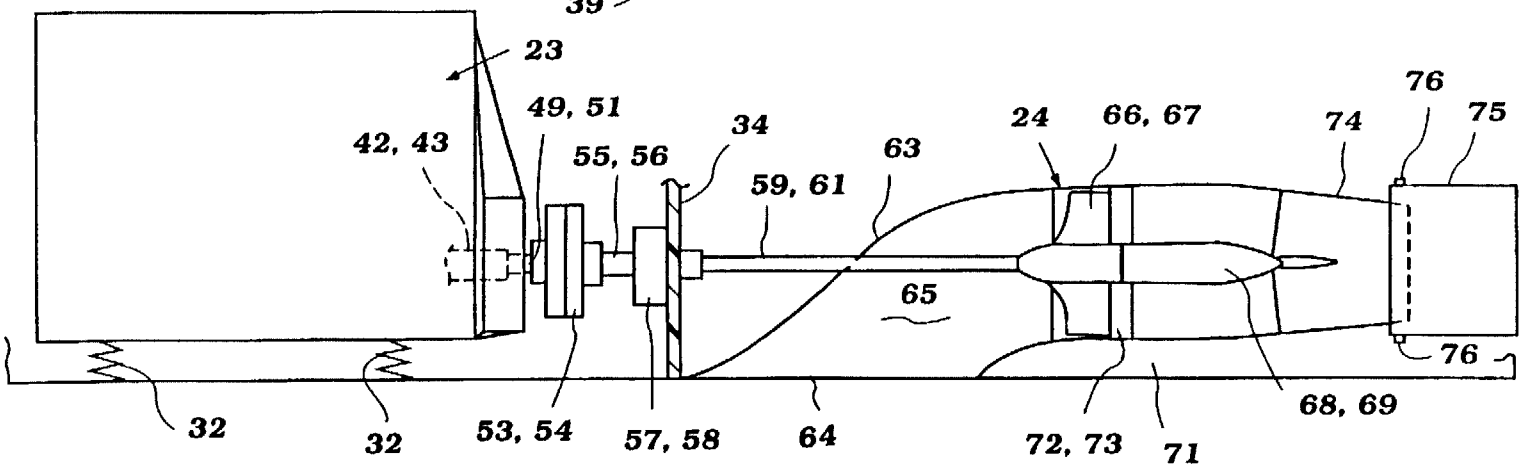
FIG. 5 is a side elevational view, in part similar to FIG. 1, again showing more detail of the construction of the jet propulsion units and the drive therefor.

The engine 23 is mounted in the hull 25 on resilient engine mounts, shown schematically in FIG. 5 and identified by the reference numerals 32. These engine mounts 32 and the engine 25 are provided in an engine compartment 33 which is disposed in substantial part beneath the seat 26 and forwardly of a bulkhead 34 of the hull 25. The bulkhead 34 is formed at the forward end of a tunnel that is formed on the underside of the hull and in which the jet propulsion unit 24 is positioned. This tunnel is also disposed generally beneath the seat 26, but at the rear of it.

As will become apparent, the engine 23 may be of any well known type, but in this particular embodiment, it is depicted as being of the V-4 type and operates on the crankcase compression two-cycle principle. To this end, the engine 23 is provided with a crankcase assembly 35 from which a pair of cylinder banks 36 and 37 extend in an upward and diverging fashion. Each of the cylinder banks 36 and 37 is formed with two cylinder bores in which respective pistons 38 are slidably supported. The pistons 38 are connected by means of connecting rods 39 to respective throws 41 of crankshafts 42 and 43 that are rotatably journaled within the crankcase 35 in any well known manner. The use of engines having two crankshafts has a particular advantage in conjunction with this embodiment, for a reason which will shortly become apparent.

As is typical with two-cycle crankcase compression engines, the individual crankcase chambers associated with each of the cylinder bores of each cylinder bank 36 and 37 is sealed from the others. An induction system is provided for delivering a charge to these crankcase chambers. In order to maximize the space utilization and permit the engine 23 to be mounted beneath the seat 26, in this embodiment, this induction includes a plurality of charge formers 44 that are aligned along the valley formed between the cylinder banks 36 and 37. An air inlet device 45 gathers air from within the engine compartment 33 and delivers it to the carburetors 44 for providing a fuel/air charge to the crankcase chambers. As noted the actual internal construction of the engine 23 may be of any conventional type. For that reason it will not be described further.

Each cylinder bank 36 and 37 is provided with a respective exhaust manifold and expansion chamber device 46 and 47, which is shown in phantom lines in FIG. 3. These exhaust systems collect the exhaust gases from the exhaust ports, which are formed on the outer sides of the cylinder banks 36 and 37. The devices 46 and 47 then deliver the exhaust gasses upwardly to a respective expansion chamber device that runs along the length of the engine for downward discharge through respective exhaust pipes 48, as seen in FIG. 1. These exhaust pipes discharge the exhaust gases to the atmosphere through a suitable exhaust system, which may include a water trap device (not shown) so that the exhaust gases can be discharged to the atmosphere through the body of water in which the watercraft is operating, without fear that the water can enter the engine through the exhaust system.

Figure 4:
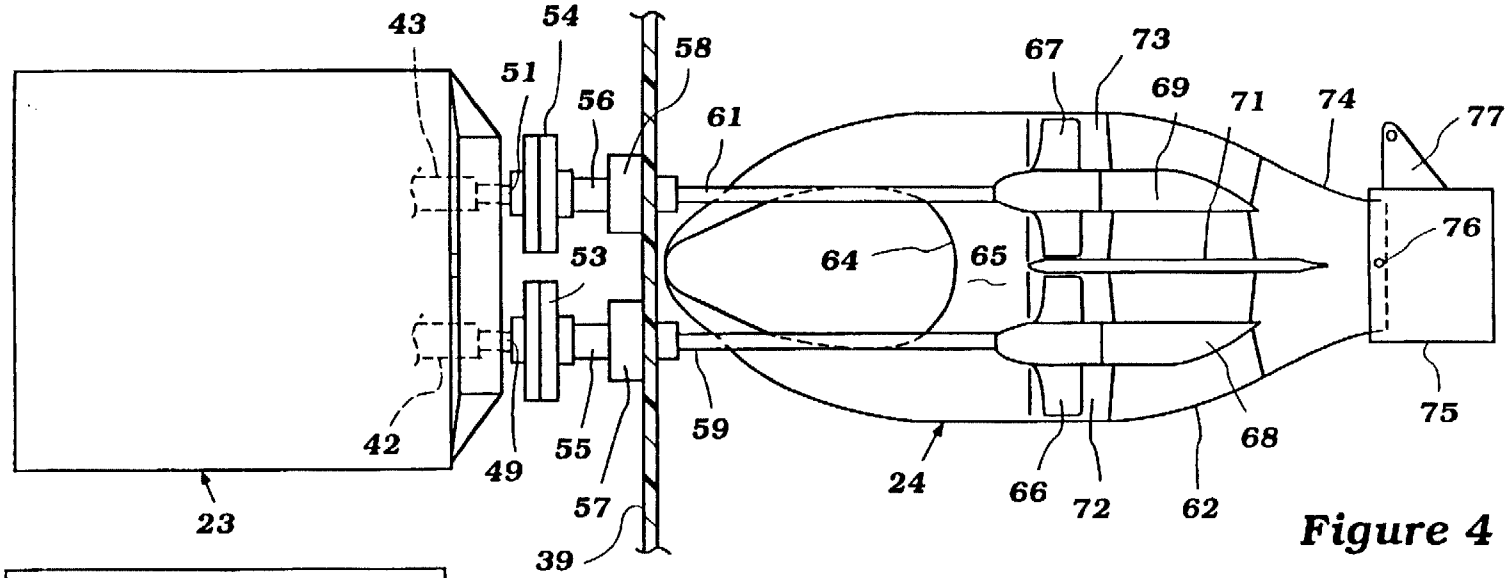
FIG. 4 is a top plan view, in part similar to FIG. 2, but showing the jet propulsion units and the drive thereof in more detail.

Referring now primarily to FIGS. 4 and 5, each of the crankshafts 42 and 43 has a respective exposed rear portion 49 and 51 which is coupled to a respective elastic coupling 53 and 54. The elastic couplings 53 and 54, in turn, transmit their power to a pair of short driveshafts 55 and 56 which extend rearwardly to the bulkhead 34 and are journaled therein by combined bearing blocks and seals 57 and 58. These bearing blocks and seals 57 and 58 seal against water entering the engine compartment through the bulkhead 34 and also permit some misalignment between the engine output shaft portions 49 and 51 and impeller shafts 59 and 61 of the jet propulsion unit 24. These impeller shafts 59 and 61 are journaled at their forward ends in the bearing blocks 57 and 58 and have splined connections to the driveshafts 55 and 56, respectively.

As may also be best seen in FIGS. 4 and 5, the jet propulsion unit 24 is comprised of an outer housing assembly 62 which may be made up of a single-piece construction or a multiple-part construction. This housing 62 includes a water inlet portion 63 which extends forwardly and downwardly to define a downwardly facing water inlet opening 64. This inlet opening 64 is aligned with a corresponding opening formed in the undersurface of the hull 25. Alternatively, the opening 64 may be formed in part by the hull itself. The opening 64 is positioned centrally in the hull undersurface.

The water inlet opening 64 serves a water inlet channel 65 which extends rearwardly to a pair of impellers 66 and 67, each affixed to a respective one of the impeller shafts 59 and 61. The rear ends of the impeller shafts 59 and 61 are journaled in respective nacelles 68 and 69 formed in the outer housing 62. It should be noted that a dividing wall 71 extends through the area between the impellers 66 and 67 forwardly into the water inlet duct 65 and terminates at a point forwardly of the impellers 66 and 67.

Because of the use of the single water inlet opening 64, the water inlet opening may be positioned centrally in the underside of the hull 25, and thus it will be ensured that this opening 64 is substantially completely covered by water, even during sharp maneuvering. Also, since the water inlet duct 65 is generally undisturbed from the inlet opening 64 rearwardly, the water need not be turned through sharp angles from the inlet opening 64 to the respective impellers 66 and 67, so the flow resistance will be decreased and pumping efficiency increased.

However, the impellers 66 and 67 tend to cause a swirl in the water inlet flow and, accordingly, the dividing wall 71 extends forwardly of the impellers 66 and 67 a sufficient distance so that the swirl from one impeller will not interfere with the flow to the adjacent impeller. Thus, there are provided a pair of separate flow paths 72 and 73, each associated with a respective one of the impellers 66 and 67, so that each impeller's action will not interfere with the other.

However, the flow paths 72 and 73 merge into a common discharge nozzle 74 formed by the outer housing 62. The dividing wall 71 extends in part back into this common discharge portion 74, but in other regards no straightening vane is required on the downstream end of the flow paths 72 and 73. In this way, the two impellers 66 and 67 and their flow paths 72 and 73 can provide good pumping efficiency and yet the effect of swirl will be dissipated in the discharge nozzle 74 without requiring the use of flow restricting straightening vanes.

Finally, a steering nozzle 75 is supported at the downstream end of the discharge nozzle 74 by means of a pair of vertically extending pivot pins 76. This steering nozzle 75 has an integral lever 77 on one side thereof that is coupled to the handlebar assembly 31, for example, through a Bowen wire actuator, for the aforenoted steering of the watercraft.

Figure 6:
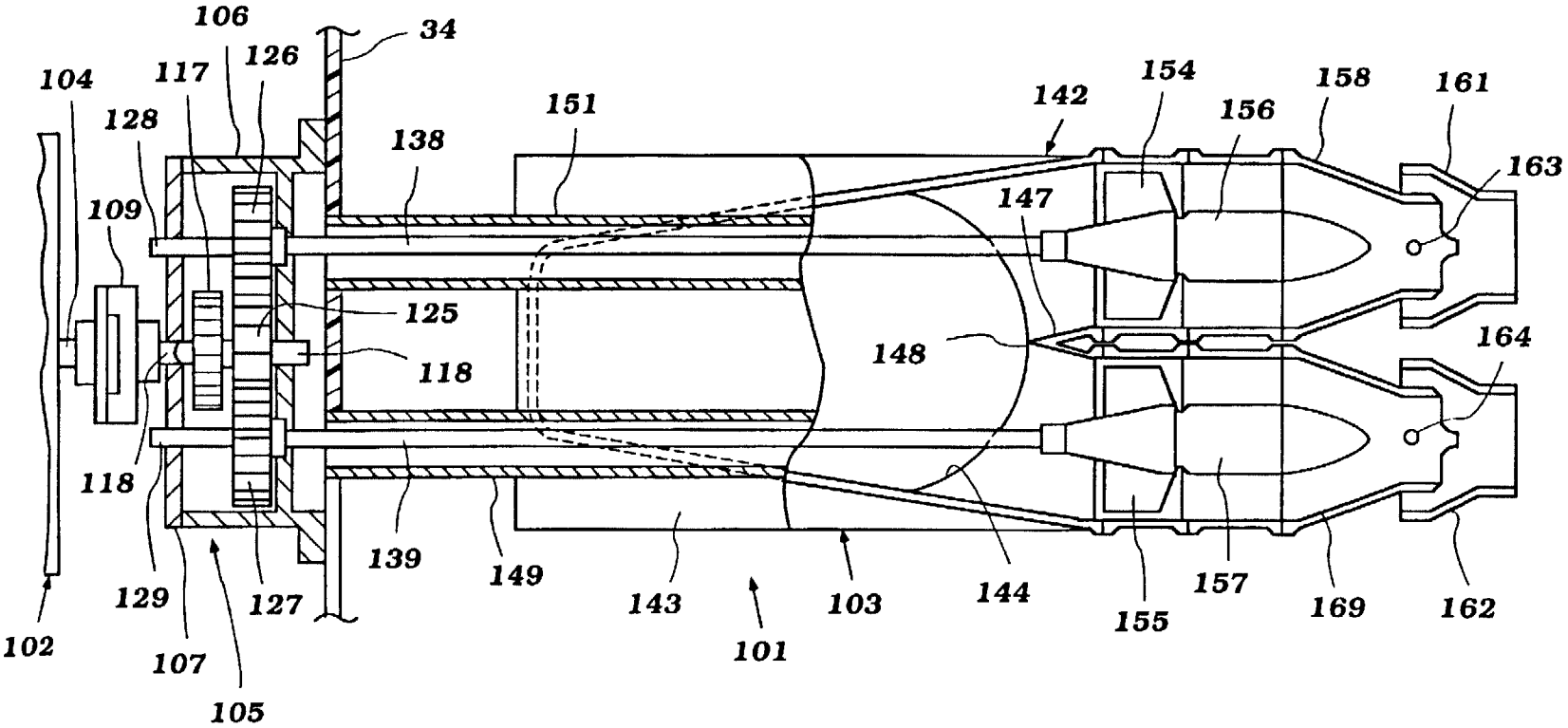
FIG. 6 is a top plan view, in part similar to FIGS. 2 and 4, with portions broken away and showing another embodiment of the invention.
Figure 7:
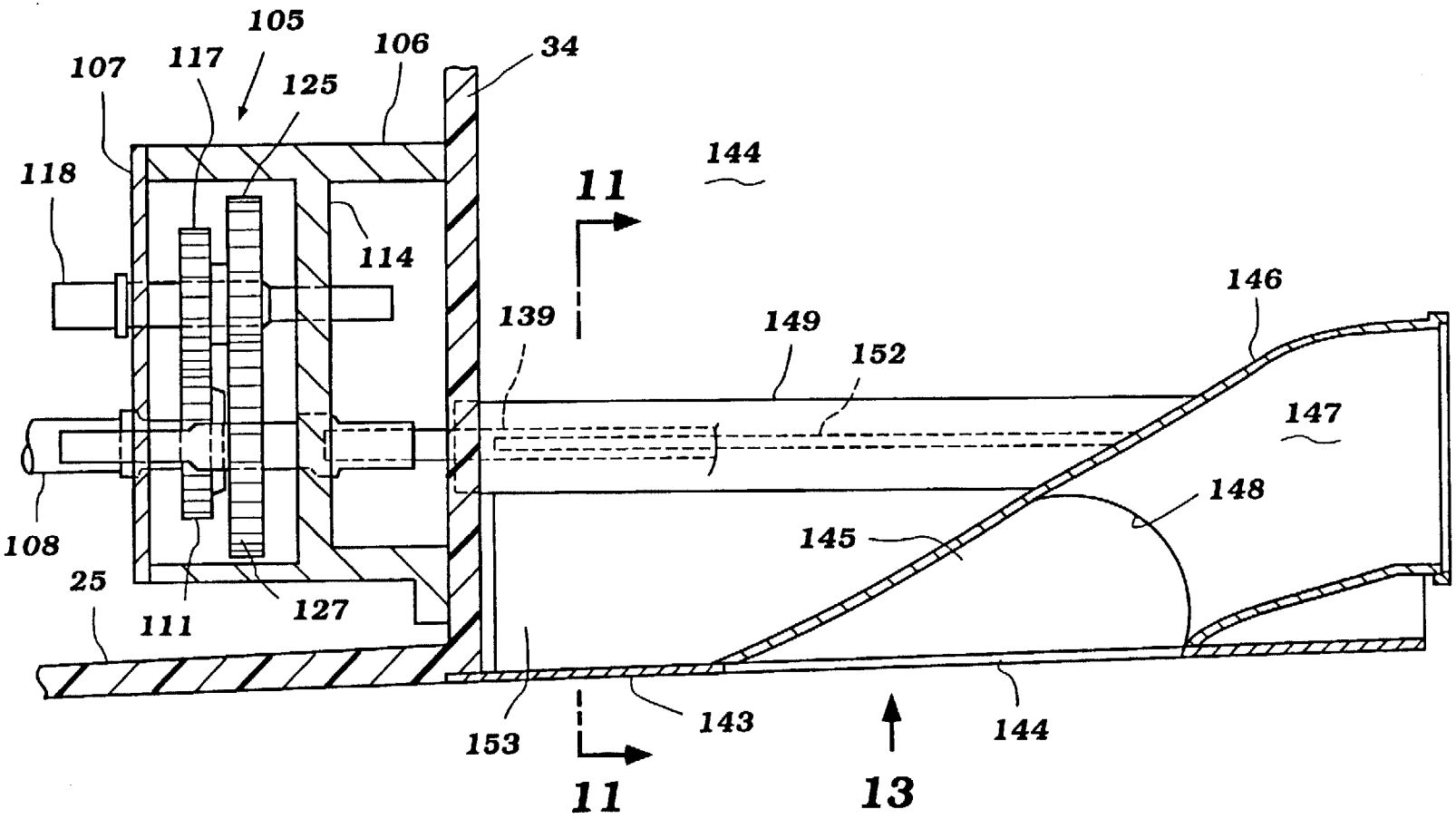
FIG. 7 is a side elevational view, with portions broken away and shown in section, of this embodiment.
Figure 8:
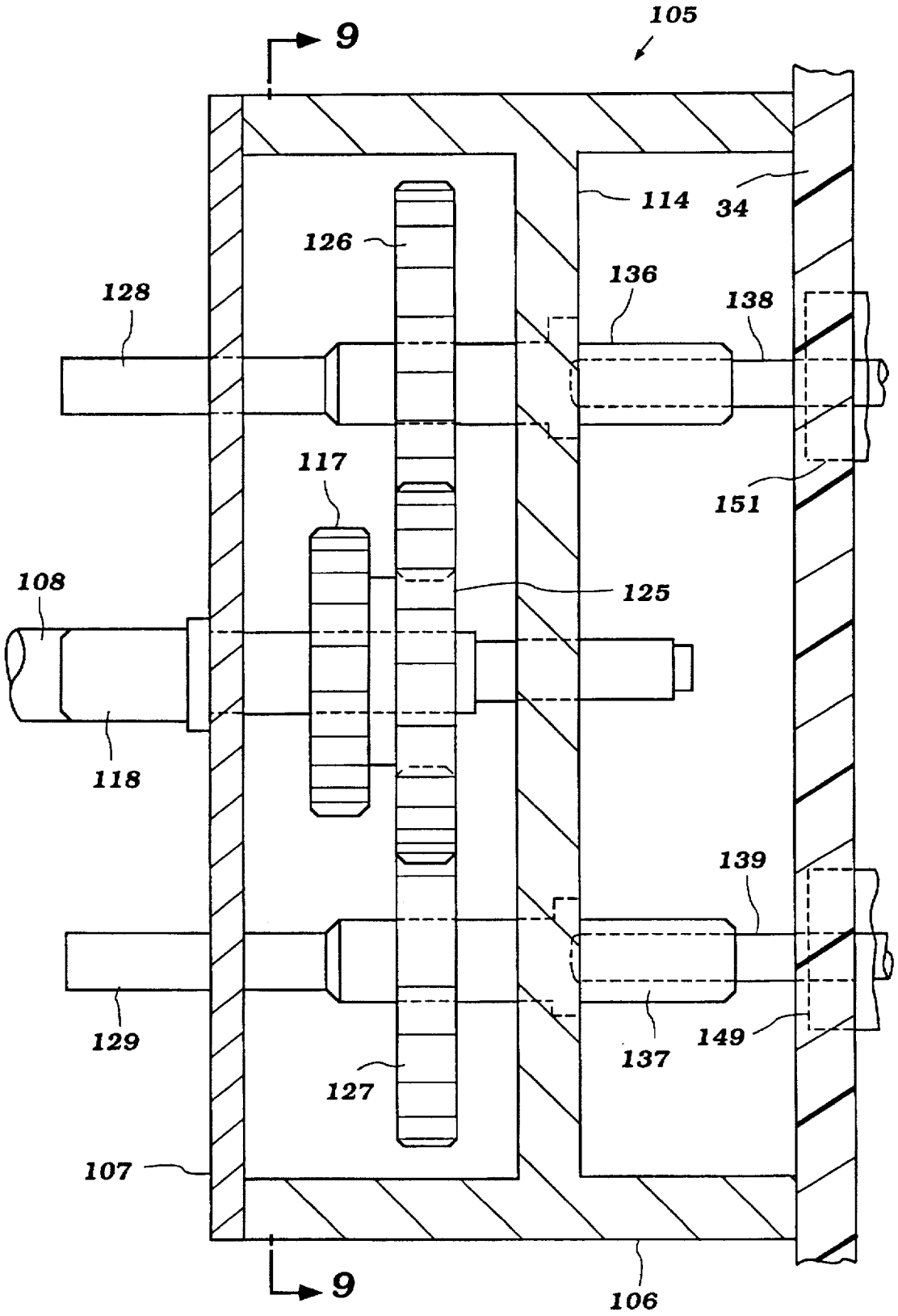
FIG. 8 is a cross-sectional view, in part similar to FIG. 6, but on an enlarged scale and showing more details of the construction of the transmission.
Figure 9:
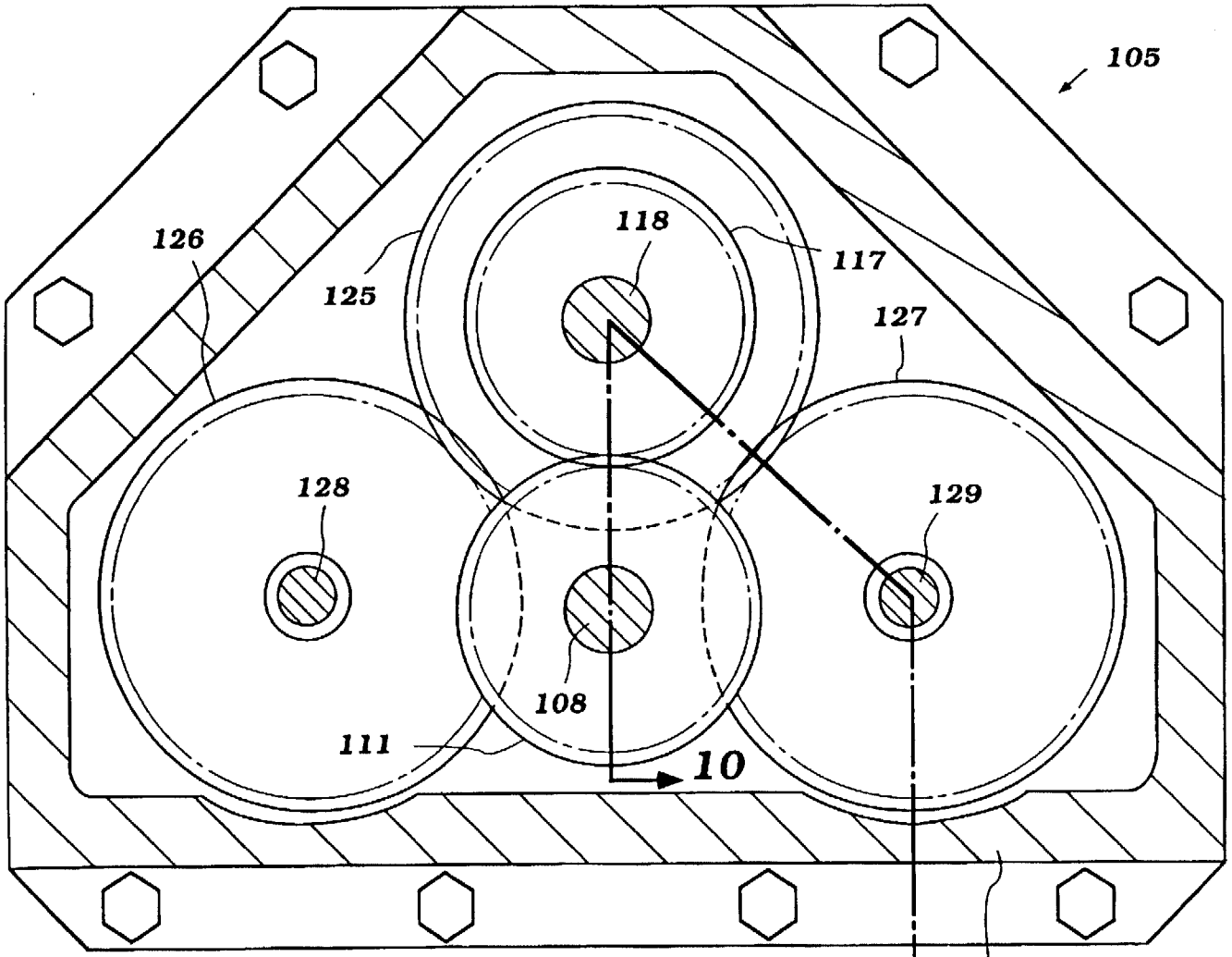
FIG. 9 is a cross-sectional view taken along the line 9—9 of FIG. 8.

Referring now to the embodiment of FIGS. 6–13, and initially to FIG. 6, a propulsion unit constructed in accordance with another embodiment of the invention is indicated generally by the reference numeral 101. It is believed that from the foregoing description that those skilled in the art will readily understand how the propulsion unit 101 can be incorporated in a watercraft, and for that reason, only limited portions of the watercraft are illustrated. Where portions of the watercraft are illustrated, they have been identified by the same reference numerals as applied in the embodiment of FIGS. 1–5.

Like the previously described embodiment, the propulsion unit 101 includes an internal combustion engine, indicated generally by the reference numeral 102 and a jet propulsion unit, indicated generally by the reference numeral 103. In this embodiment, however, the engine 102 is of the type which has only a single output shaft 104.

Therefore, a transmission 105 is interposed between the engine output shaft 104 and the jet propulsion unit 101 for driving the two impellers of the jet propulsion unit. Since this embodiment is designed for utilization with conventional engines having only a single crankshaft, any further details of the engine 102 are not illustrated. Those skilled in the art will readily understand from the following description how the invention can be utilized in conjunction with any type of internal combustion engine.

The transmission 105 and its interconnection with the engine output shaft 104 will now be described by primary reference to FIGS. 6–10. The transmission 105 is comprised of an outer housing member 106 that is mounted on the front of the bulkhead 35 within the engine compartment and which defines a transmission casing that is closed by means of a cover plate 107.

The engine output shaft 104 drives a transmission input shaft 108 through a flexible coupling 109 (FIG. 6). The transmission input shaft 108 has affixed to it within the transmission case a transmission input gear 111 which may be best seen in FIG. 10. The forward end of the input shaft 108 is journaled by means of a pair of ball bearing journals 112 carried by the transmission cover plate 107. The aft end of the input shaft 108 is journaled by a roller bearing 113 that is carried by an intermediate wall 114 of the main transmission housing piece 106. A pair of thrust bearings 115 and 116 provide axial location for the transmission input shaft 108.

The transmission input gear 111 drives a driven gear 117 that has a splined connection to an intermediate shaft 118 which is journaled for rotation about an axis that lies vertically above and transversely in line with the transmission input shaft 108. The intermediate shaft 111 is journaled by a pair of ball bearings 119 carried in a bearing carrier 121 which is fixed to the transmission cover plate 107 at its forward, end. In addition, and like the transmission input shaft 108, the intermediate shaft 118 is journaled at its rear end by a needle bearing 122 carried by the transmission intermediate wall 114. A pair of thrust bearings 123 and 124 provide axial location for the transmission intermediate shaft 118.

The ratio of diameters between the transmission input gear 111 and the driven gear 117 may be unitary or, if desired, there may be a stepped down ratio between them. A speed reduction may be required to permit higher engine speeds without causing cavitation. In either event, the driven gear 117 has associated with it a transmission gear 125 which has a splined connection with the intermediate shaft 118 and therefore rotates with the driven gear 117. This transmission gear 125 has a driving engagement with a pair of driven gears 126 and 127. Each of these gears is affixed for rotation with a respective transmission output shaft 128 and 129.

Figure 10:
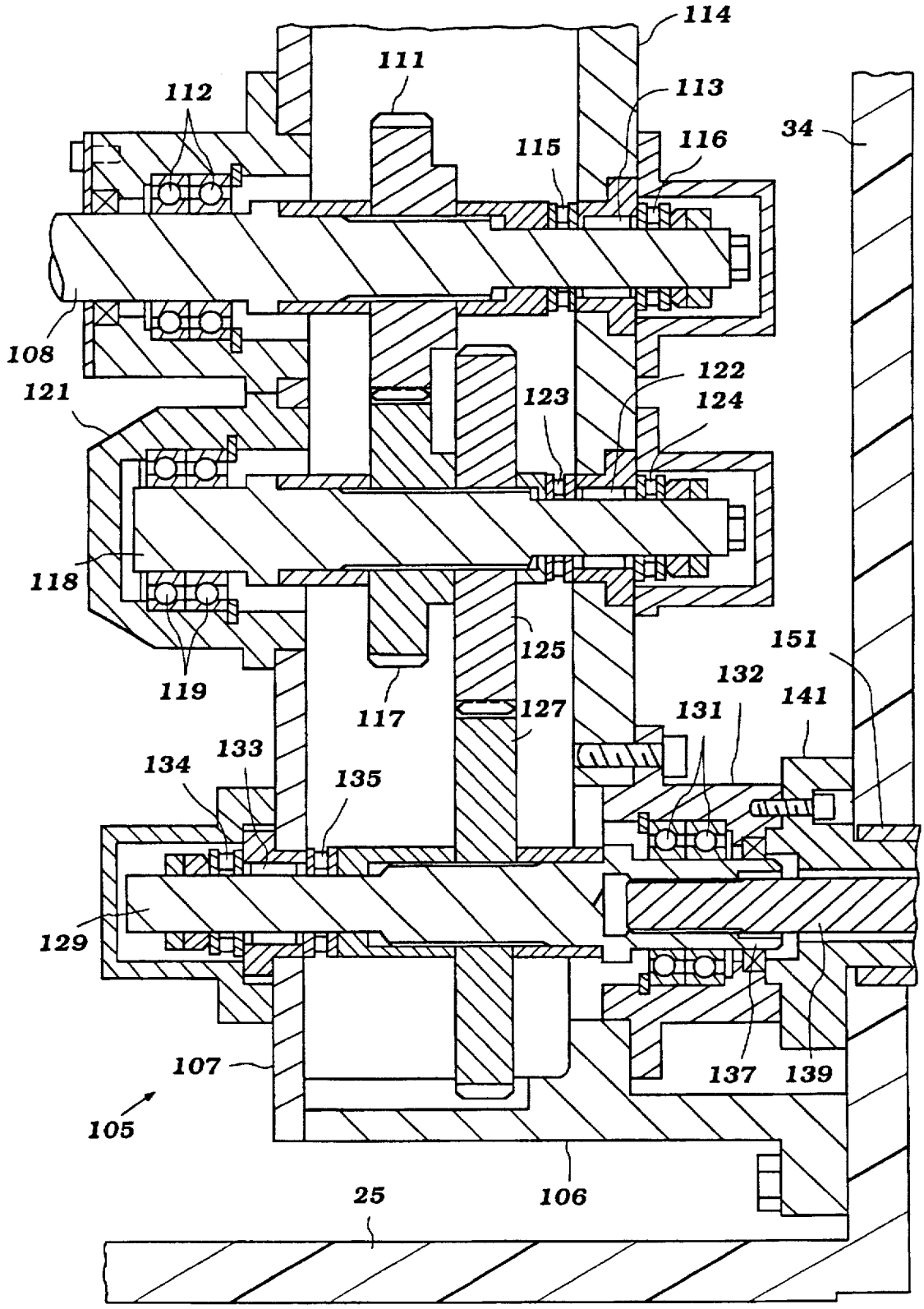
FIG. 10 is a cross-sectional view taken along the line 10—10 of FIG. 9 and shows further details of the transmission.
Figure 11:
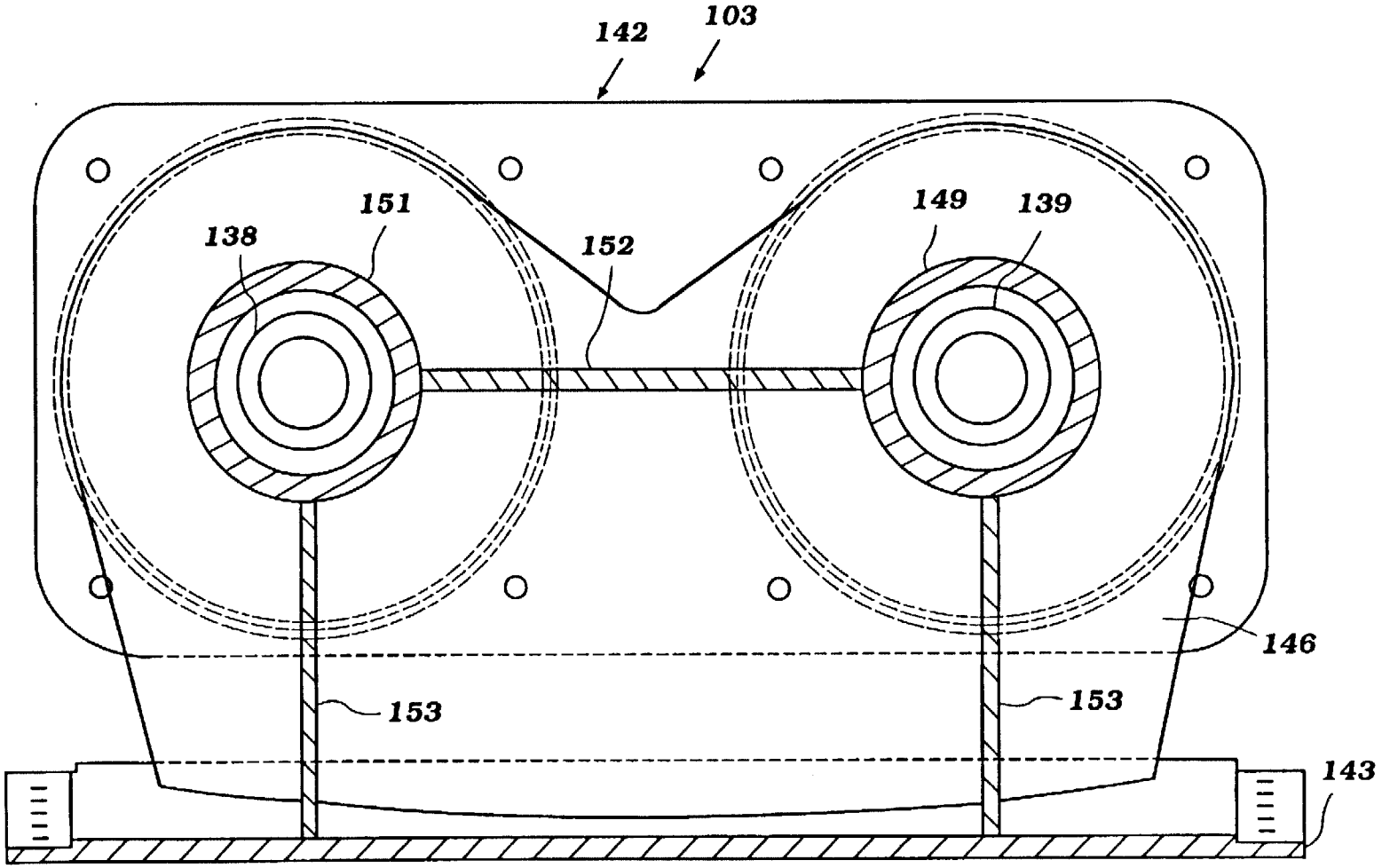
FIG. 11 is a cross-sectional view taken along the line 11—11 of FIG. 7.
Figure 12:
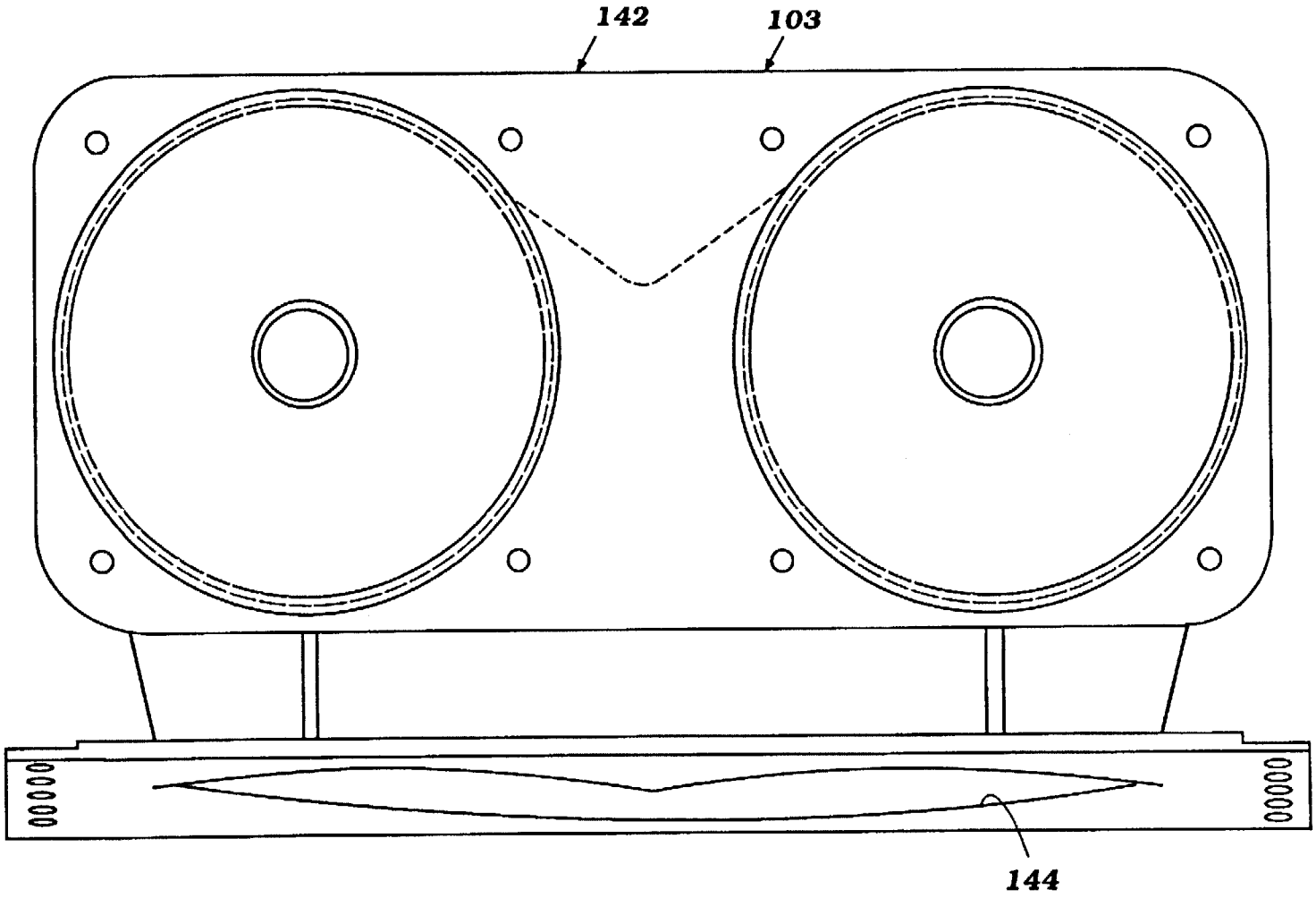
FIG. 12 is a rear elevational view showing the discharge end of the jet propulsion unit.
Figure 13:
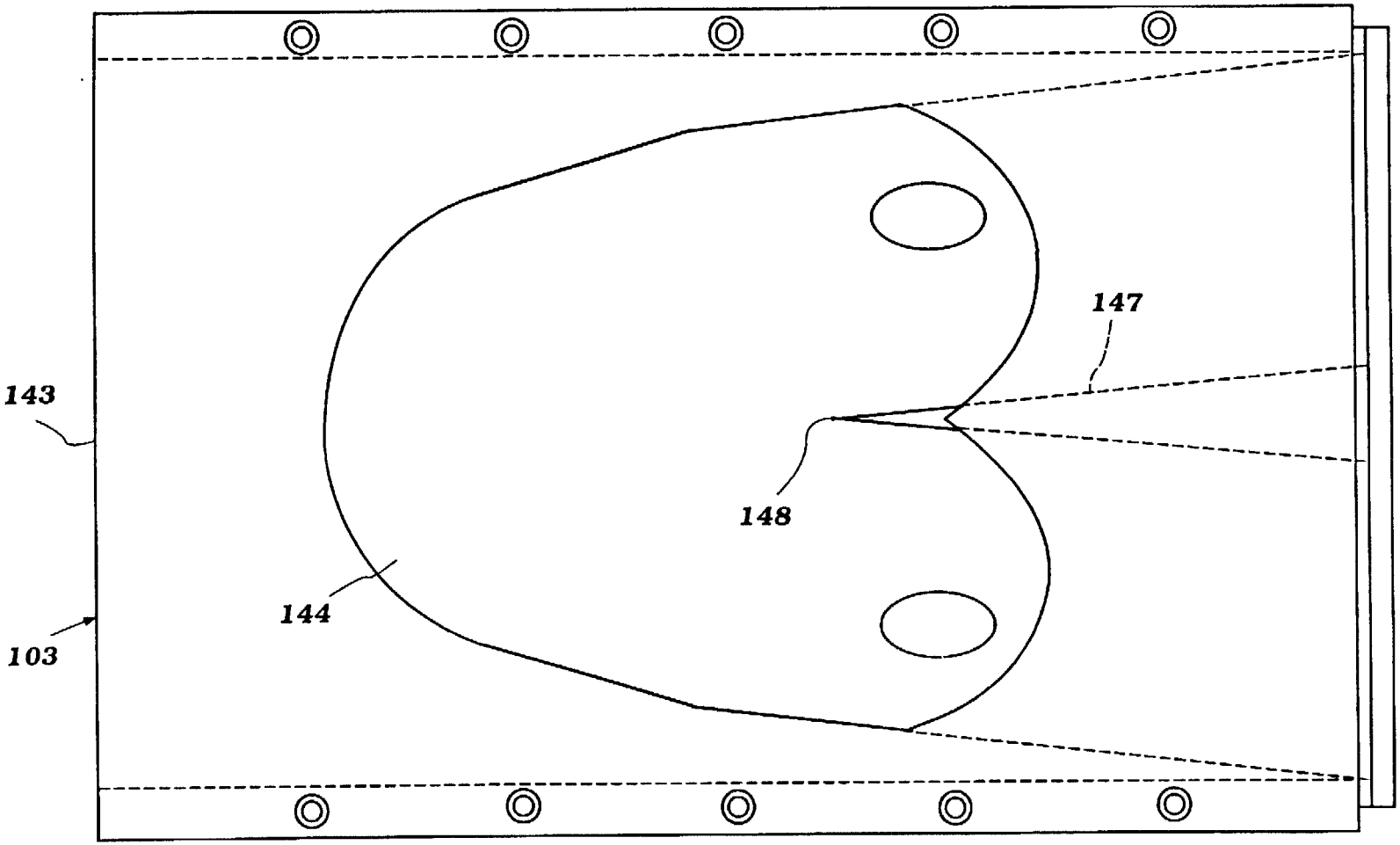
FIG. 13 is a bottom plan view showing the underplate and configuration of the water inlet opening of this embodiment.

The journaling for these shafts is also best illustrated in FIG. 10, wherein the journal arrangement for the transmission output shaft 129 is shown. It is to be understood, however, that the shaft 128 is supported in an identical manner. A pair of ball bearings 131 have their internal races affixed to the transmission output shaft 129 and their external races fixed in a bearing support 132 that is fixed to the intermediate wall 114. This connection is at the aft end.

The forward end of the transmission shafts 128 and 129 are journaled by needle bearings 133 formed in a member that is carried by the transmission case front wall 107. A pair of thrust bearings 134 and 135 are disposed on opposite sides of this bearing carrier and provide the axial location for the transmission output shafts 129.

Each of the transmission output shafts 128 and 129 have enlarged portions 136 and 137 that extend behind the transmission case intermediate wall 114 and toward the bulkhead 34. Each of these enlarged projections 136 and 137 is formed with an internally splined opening that receives the externally splined end of a respective impeller shaft 138 and 139.

As may be best seen in FIG. 10, these impeller shafts 138 and 139 (the shaft 139 being shown in FIG. 10) extend through support blocks 141 which are affixed to the front of the bulkhead 34 and to the bearing blocks 132 of the transmission assembly 105.

Thus, from the foregoing description, it should be readily apparent that the impeller shafts 138 and 139 are driven by the transmission described at the desired speed ratio and in the same direction. The association of these impeller shafts with the jet propulsion unit 103 will now be described by reference to FIGS. 6, 7 and 11–13.

As with the previously described embodiment, the jet propulsion unit 103 is comprised of an outer housing assembly, indicated generally by the reference numeral 142, and which has a water inlet opening defining portion at its forward end. This portion is comprised of a lower flange-type plate 143 that is disposed in substantial alignment with the underside of the hull 25 and provides a closure at the forward end of a tunnel 144 in which the jet propulsion unit 103 is mounted.

As with the previously described embodiment, there is defined a single water inlet opening 144 which faces downwardly and which serves a water inlet duct 145 formed by a duct-forming portion 146 of the housing 142. This duct-forming portion 146 is provided in part with an internal wall 147 which has a curved forward end 148 that divides the water flow path 145 into a pair of flow paths. As will be seen in FIGS. 7 and 13, the upper end of this wall extends forwardly of the rear end of the opening 144 to assist in this separation. The lower end of the wall 147, however, is at the rear end of the opening 144 so that the water flowing from the inlet opening 144 to the individual impellers, to be described, will not have to turn through any substantial angle. However, the wall 147 and particularly its upper end extends sufficiently forwardly so that the swirling motion generated to the inlet charge entering each impeller will not be transmitted to the other.

It should be noted that this housing portion also defines a pair of tubular extensions 149 and 151, each of which encircles the respective impeller shaft 139 and which is received within the bulkhead 134 so as to provide a water-tight seal at the bulkhead.

A bridging wall 152 (FIG. 11) extends between these tubular portions 149 and 151 so as to provide reinforcing. In addition, a pair of vertical walls 153 extend between the tubular portions 149 and 151 and the lower flange 143 so as to provide further rigidity for the housing assembly.

Referring now primarily to FIG. 6, it will be seen that impellers 154 and 155 are affixed in a suitable manner to the impeller shafts 138 and 139, respectively. The rear ends of the impeller shafts 138 and 139 are journaled within the nacelles 156 and 157 that are formed forwardly of discharge nozzle portions 158 and 159 of the jet propulsion unit housing assembly 142. In this embodiment, separate discharge nozzle portions are provided.

Steering nozzles 161 and 162 are supported on the discharge nozzle portions 158 and 159 by respective vertically extending pivot pins 163 and 164 for steering of the steering nozzles 161 and 162. The steering nozzles 161 and 162 may be interconnected through a suitable linkage system with the handlebar assembly 31 for steering in a well known manner.

Figure 14:
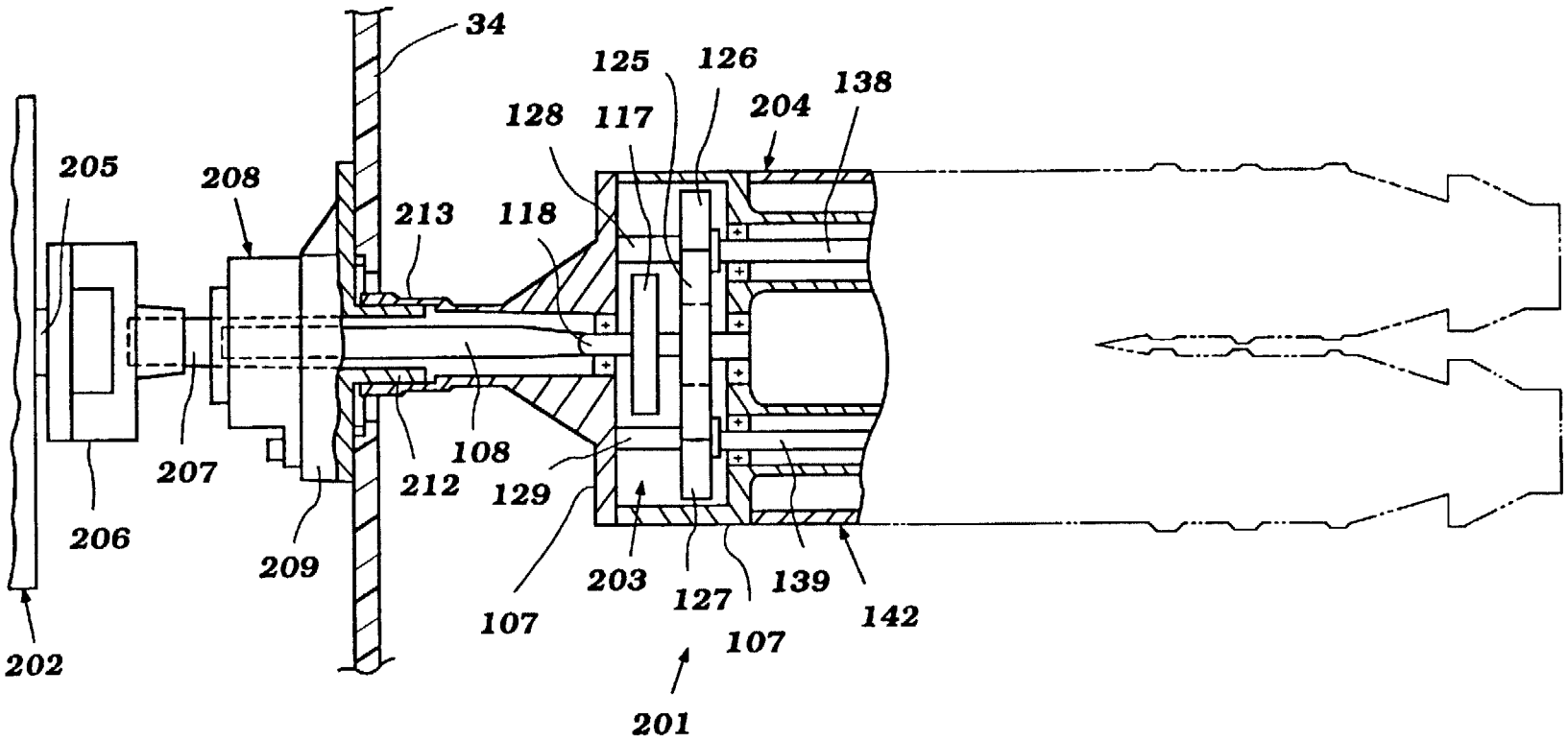
FIG. 14 is a top plan view, in part similar to FIGS. 2, 4 and 6, and shows yet another embodiment of the invention.
Figure 15:
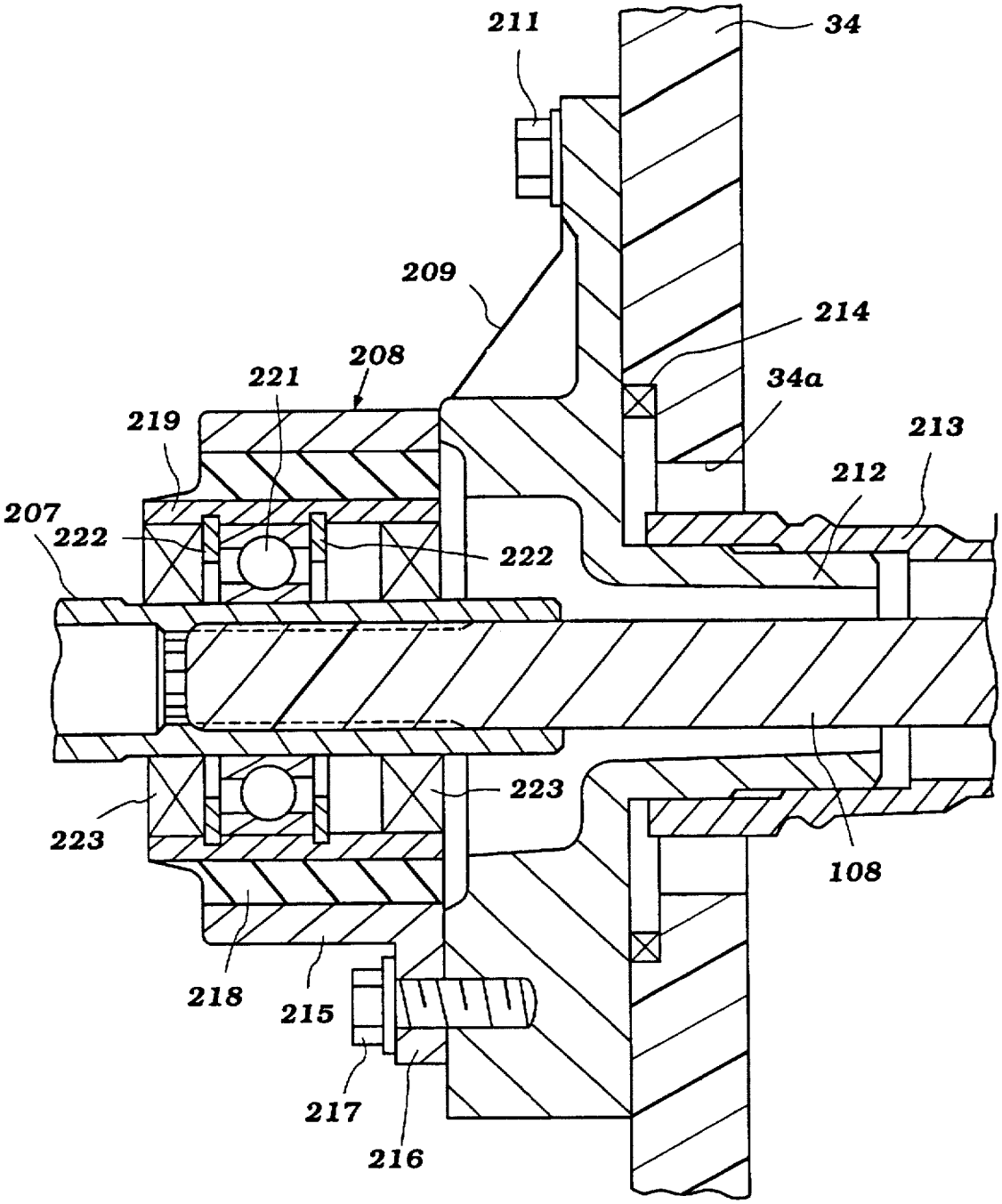
FIG. 15 is an enlarged cross-sectional view showing the transmission input shaft connection for this embodiment.

A propulsion unit constructed in accordance with a third embodiment of the invention is shown in FIGS. 14 and 15, and is identified generally by the reference numeral 201. Like the embodiment of FIGS. 6–13, this embodiment includes a powering internal combustion engine 202, a transmission 203, and a jet propulsion unit, indicated generally by the reference numeral 204.

This embodiment, like the embodiment of FIGS. 6–13, uses an engine that has a single engine output shaft 205 and the transmission 203 splits the drive from this output shaft into a drive for the separate impellers of the jet propulsion unit 204 which, except for the way in which the impeller shafts are driven, has the same construction as the jet propulsion unit of FIGS. 6–13. Therefore, the impeller shafts are indicated by the same reference numerals used in describing the previous embodiment 138 and 139. The outer housing assembly is also indicated by the same reference numeral 142.

In this embodiment, however, the transmission 203 is built into the front of the jet propulsion unit 204 and thus is disposed in the tunnel. This provides some rearward shifting of the weight and permits the engine 202 to be moved further back toward the bulkhead 34 or, alternatively, permits the bulkhead 34 to be moved forwardly in the hull.

Since the internal construction of the transmission 203 is the same as that of the transmission 105 of the previously described embodiment, components of this transmission which are the same have been identified by the same reference numerals and will not be described again. Thus, the only difference in actual structure of this embodiment from the previous embodiment is the way in which the drive is transmitted from the engine output shaft 205 to the transmission input shaft 108. Thus, only FIGS. 14 and 15 are necessary to show this construction, and it is actually shown in most detail in FIG. 15. It should be apparent from the previous descriptions and the use of common reference numerals between this embodiment and those previously described, how this embodiment operates.

As with the previously described embodiments, the engine output shaft 205 is connected to a flexible coupling 206 which, in turn, drives a driveshaft 207. The driveshaft 207 is supported within a combined flexible support and coupling arrangement, indicated generally by the reference numeral 208. The supporting arrangement 208 is mounted, in a manner which will be described, to the bulkhead 34 on the engine compartment side thereof.

This supporting assembly includes a mounting plate 209 that has a flange portion which is affixed by fasteners 211 to the front side of the bulkhead 34. Furthermore, a pilot portion 212 of the mounting bracket 209 extends through an opening **34*a* formed in the bulkhead 34. An elastic seal 214 is positioned between the forward portion of the bulkhead opening 34*a* and the mounting flange 209** so as to provide a water-tight seal.

The coupling and flexible support 208 is comprised of an outer housing 215 having a flange portion 216 that is affixed to the mounting bracket 208 by threaded fasteners 217. This mounting portion 215 defines an internal opening in which an elastic cylindrical member 218 is affixed, as by bonding. The elastic member 218 is, in turn, bonded to an internal sleeve 219 in which a ball bearing 221 is affixed by means of a pair of snap rings 222. The ball bearing 221 rotatably journals the driveshaft 207. A pair of seals 223 are provided on opposite sides of the bearing 221 within the sleeve 219 so as to seal and protect the bearing 221.

The driveshaft 207 has a female splined rear portion in which a splined end of the transmission shaft 108 is received for establishing a driving connection between the driveshaft 207 and the transmission input shaft 108.

The cover plate 107 of the transmission is provided with a forwardly extending pilot portion 213 which has a sealing engagement with the pilot portion 212 of the mounting bracket 209 so as to provide a water-tight seal around the transmission driveshaft 108.

The transmission driveshaft 108 drives the impeller shafts 138 and 139 in the same manner as described in the embodiments of FIGS. 6–13 and, therefore, further description of this embodiment of the invention is not believed to be necessary to permit those skilled in the art to practice it.

Thus, from the foregoing descriptions, it should be readily apparent that the described embodiments of the invention provide a very compact, high-efficiency jet propulsion system for watercraft embodying two impellers which are contained substantially within a common housing having a common inlet portion that can be disposed centrally of the watercraft hull in a transverse direction to ensure that neither unit will run dry during abrupt maneuvering. In addition, the construction generally ensures that straightening vanes are not necessary, and also reduces the effect of the swirling motion generated at the inlet section to each impeller without interference from the other.

Of course, the foregoing description is that of preferred embodiments of the invention, and various changes and modifications may be made without departing from the spirit and scope of the invention, as defined by the appended claims.

I claim:

1. A jet propulsion unit for propelling a watercraft comprising a housing assembly defining a water inlet portion including a single water inlet opening and a water inlet duct extending from said water inlet opening, and a pair of flow paths separated by a dividing wall and communicating with the inlet duct, a pair of impellers supported for rotation about parallel axes in side-by-side relationship downstream of said water inlet opening, each impeller being positioned in a respective one of the flow paths, discharge nozzle means receiving water pumped by said impellers for discharge to provide a propulsive force for an associated watercraft, the dividing wall having at least a portion extending forwardly of the rearward most end of the water inlet opening and into said water inlet duct.

2. The jet propulsion unit as set forth claim 1, wherein the water inlet opening is downwardly facing.

3. The jet propulsion unit as set forth claim 2, wherein the water inlet opening is disposed generally at the center of the housing assembly so that it can be positioned at the center of the hull of the associated watercraft to reduce the likelihood of drawing air into the water inlet opening under abrupt movement.

4. The jet propulsion unit as set forth in claim 1, wherein an upper portion of the dividing wall extends forwardly of the rearward most end of the water inlet opening.

5. The jet propulsion unit as set forth in claim 4, wherein a lower end of the dividing wall terminates at the rearward most end of the water inlet opening.

6. A jet propulsion unit for propelling a watercraft, comprising a housing assembly defining a water inlet portion including a single water inlet opening and a water inlet duct extending from said water inlet opening, a pair of impellers supported for rotation about parallel axes in side-by-side relationship downstream of said water inlet opening with the water inlet duct extending to the impellers, each of said impellers lying within a separate flow path that communicates with said water inlet opening, the flow paths being separated by a common dividing wall such that the impellers are separated from each other by only the common dividing wall, and a discharge device positioned to receive water pumped by at least one of said impellers for discharge to provide a propulsive force for an associated watercraft.

7. The jet propulsion unit as set forth claim 6, wherein the impellers are driven in the same direction.

8. The jet propulsion unit as set forth claim 6, wherein the discharge device comprises a single discharge nozzle receiving water pumped by both of the impellers.

9. The jet propulsion unit as set forth claim 6, wherein each of the impellers is supported within a respective impeller housing portion that extends from the impellers rearwardly and which defines, at least in part, the dividing wall.

10. The jet propulsion unit as set forth claim 1, wherein the discharge nozzle means comprises a separate discharge nozzle for each impeller with the discharge nozzles being disposed in side-by-side relationship.

11. A jet propulsion unit for propelling a watercraft, comprised of an outer housing assembly defining a water inlet portion consisting of a single water inlet opening and a water inlet duct extending from said water inlet opening, a pair of impellers supported for rotation about parallel axes in side-by-side relationship downstream of said water inlet opening, each of said impellers lying within a separate flow path that communicates with said water inlet opening with the flow paths being separated by a dividing wall, discharge nozzle means receiving water pumped by said impellers for discharge to provide a propulsive force for an associated watercraft, and an engine having at least two output shafts with each impeller being driven by a respective engine output shaft, the engine output shafts forming separate crankshafts of the engine.

12. The jet propulsion unit as set forth claim 11, wherein each engine crankshaft is driven by at least one piston associated with a respective cylinder bank.

13. A jet propulsion unit for propelling a watercraft, comprised of an outer housing assembly defining a water inlet portion consisting of a single water inlet opening and a water inlet duct extending from said water inlet opening, a pair of impellers supported for rotation about parallel axes in side-by-side relationship downstream of said water inlet opening, each of said impellers lying within a separate flow path that communicates with said water inlet opening with the flow paths being separated by a dividing wall, discharge nozzle means receiving water pumped by said impellers for discharge to provide a propulsive force for an associated watercraft, and an engine having a single output shaft which drives a pair of impeller shafts through a transmission, the transmission being separated from the jet propulsion unit outer housing by a bulkhead of an associated watercraft and being mounted to the bulkhead, the transmission including at least two output shafts which are detachably connected to the impeller shafts.

14. The jet propulsion unit as set forth claim 13, wherein the transmission includes a gear train configured to change in speed between an output shaft of the engine and the impeller shafts connected to the output shafts of the transmission.

15. The jet propulsion unit as in claim 14, wherein the transmission includes an input shaft and the gear train includes at least a pair of speed reduction gears.

16. The jet propulsion unit as in claim 15, wherein the transmission includes an intermediate shaft which is positioned above the input shaft and supports an intermediate gear in mesh engagement with an input gear carried by the input shaft.

17. The jet propulsion unit as in claim 16, wherein the intermediate shaft also carries a drive gear which drives a driven gear carried by each of the output shafts of the transmission.

18. The jet propulsion unit as in claim 17, wherein the output shafts of the transmission are arranged on opposite sides of the input shaft and each output shaft lies beside the transmission input shaft.

19. The jet propulsion unit as in claim 1, wherein the impellers are driven in the same direction.

20. The jet propulsion unit as in claim 1, wherein each of the impellers is supported within a respective impeller housing portion that extends from the impellers rearwardly and which defines, at least in part, the dividing wall.

21. The jet propulsion unit as in claim 1, wherein the portion of the dividing wall, that extends forwardly of the rearward most end of the water inlet opening, has an curvilinear leading edge.

22. The jet propulsion unit as in claim 6, wherein the water inlet opening is downwardly facing.

23. The jet propulsion unit as in claim 22, wherein the water inlet opening is disposed generally at the center of the housing assembly so that it can be positioned at the center of the hull of the associated watercraft.

24. The jet propulsion unit as in claim 11, wherein the dividing wall is a common wall dividing the separate flow paths in which the impellers are disposed, and the inlet duct extends to the impellers.

* * * * *